US011473869B1

(12) United States Patent
Brandt et al.

(10) Patent No.: US 11,473,869 B1
(45) Date of Patent: Oct. 18, 2022

(54) COMPRESSION SCREW ATTACHMENT SYSTEM

(71) Applicant: BattleArms IP, LLC, Henderson, NV (US)

(72) Inventors: Eli S. Brandt, Fredericksburg, VA (US); George Huang, Henderson, NV (US)

(73) Assignee: Battlearms IP, LLC, Henderson, NV (US)

( * ) Notice: Subject to any disclaimer, the term of this patent is extended or adjusted under 35 U.S.C. 154(b) by 0 days.

(21) Appl. No.: 16/688,694

(22) Filed: Nov. 19, 2019

(51) Int. Cl.
*F41A 35/00* (2006.01)
*F41A 3/66* (2006.01)
*F41A 17/00* (2006.01)

(52) U.S. Cl.
CPC ..... *F41A 35/00* (2013.01); *F41A 3/66* (2013.01); *F41A 17/00* (2013.01)

(58) Field of Classification Search
CPC ..... F41A 35/00; F41A 35/006; F41A 17/46; F41A 17/64; F41A 17/56; F41A 17/74
USPC ..... 42/90
See application file for complete search history.

(56) References Cited

U.S. PATENT DOCUMENTS 8,276,502 B1 * 10/2012 Wright ..... F41A 17/64 89/148
8,806,790 B1 * 8/2014 Huang ..... F41A 17/74 42/70.08
9,587,897 B1 * 3/2017 Huang ..... F41A 17/70
10,126,081 B1 * 11/2018 Geissele ..... F41A 19/46
D841,755 S * 2/2019 Pavlick ..... D22/108
10,466,002 B1 * 11/2019 Geissele ..... F41A 19/02
10,563,939 B1 * 2/2020 Oglesby ..... F41A 3/38
10,670,367 B1 * 6/2020 Boyer ..... F41A 35/06
10,746,489 B1 * 8/2020 Huang ..... F41A 19/46
D896,610 S * 9/2020 Huang ..... D8/308
10,816,296 B2 * 10/2020 Karchon ..... F41A 17/46
D904,854 S * 12/2020 Huang ..... D8/308
2008/0302235 A1 * 12/2008 Lauck ..... F41A 17/46 89/132
2012/0325044 A1 * 12/2012 Brown ..... F41A 19/33 74/548
2013/0111796 A1 * 5/2013 Dionne ..... F41A 17/00 42/70.11

(Continued)

*Primary Examiner* — Joshua E Freeman
(74) *Attorney, Agent, or Firm* — Shaddock Law Group, PC

(57) ABSTRACT

A compression screw attachment system, including an attachment base having at least one projection, wherein an at least partially internally threaded compression screw recess extends from a terminal surface of the projection; at least one at least partially externally threaded compression screw, rotatable within the compression screw recess between a retracted position and an extended position; and one or more attachment elements, each having an attachment element recess, wherein a compression screw aperture is formed through the recess bottom wall, wherein if the compression screw is in the retracted position, the attachment element recess is slidably mateable with the projection of the attachment base and wherein the compression screw is threadedly rotatable to the extended position, wherein at least a portion of a head portion of the compression screw contacts a surface of the recess bottom wall and provides a force to urge the recess against the projection.

20 Claims, 14 Drawing Sheets

(56) References Cited

U.S. PATENT DOCUMENTS

| | | | | |
|---|---|---|---|---|
| 2014/0215884 | A1* | 8/2014 | Adcock, Jr. ..... | F41C 27/16<br>42/72 |
| 2016/0091268 | A1* | 3/2016 | Miller, III ..... | F41A 17/46<br>42/70.06 |
| 2017/0176122 | A1* | 6/2017 | Underwood ..... | F41A 11/00 |

* cited by examiner

COMPRESSION SCREW ATTACHMENT SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE DISCLOSURE

1. Field of the Disclosure

The present disclosure relates generally to the field of firearms and is particularly directed to improved systems and methods for attaching or coupling interchangeable components.

2. Description of Related Art

It is well known to use dovetail, picatinny, or other mating shapes to attach or couple elements together. Typically, these elements are slidably positioned relative to one another to attach or couple the elements together. Once appropriately positioned, at least one arm of the dovetail recess is manipulated to squeeze or pinch the dovetail recess to prevent further slidable movement of the attached or coupled elements, relative to one another.

Alternatively, when the elements are slidably positioned relative to one another, a screw or other fastener is attached from outside the elements to further secure the elements to prevent further slidable movement of the attached or coupled elements, relative to one another.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY AND OBJECTS OF THE DISCLOSURE

Unfortunately, in order to allow at least one arm of the dovetail recess to be manipulated to squeeze or pinch the dovetail recess, at least one arm of the dovetail recess is weakened relative to the other arm.

If an external screw or fastener is used, the screw or fastener is under tension, which does not provide as much force as a screw or other fastener under compression. Additionally, by using an external screw or fastener to join the dovetail elements, the surfaces forming the dovetail projection and dovetail recess are actually urged away from one another as the screw or other fastener is fastened. This leads to disengagement of the opposing dovetail surfaces.

These and other disadvantages of the prior art are overcome with the present disclosure, wherein the compression screw attachment system provides an internal compression screw that is rotated inward to allow dovetail or other similar mating surfaces to be slidable relative to one another. Once the elements are slidably positioned relative to one another, the internal compression screw is rotated outward, under compressional force, to urge the dovetail mating surfaces away from one another, providing additional engagement of the opposing dovetail surfaces.

In order to overcome the shortcomings of the currently known attachment arrangements and/or to provide an improved attachment system, in various exemplary, non-limiting embodiments, the compression screw attachment system of the present disclosure provides a compression screw that can be threadably inserted so as to be flush with a terminal edge of an attachment base. Then a lever or other attachment element can slide into place. Once the lever or other attachment element is appropriately positioned, the compression screw will be turned out to lock the lever or other attachment element in place, forcing further engagement of opposing surfaces of the dovetail while also centering the dovetail on its taper. This provides compression of the compression screw and also locks positively into the dovetail sides.

In various exemplary, non-limiting embodiments, the compression screw attachment system of the presently disclosed systems, methods, and/or apparatuses comprises an attachment base having at least two projection sidewalls at least partially defining at least one projection extending from the attachment base, wherein an at least partially internally threaded compression screw recess, having at least some internal threads, extends from a terminal surface of the at least one projection; at least one compression screw having at least some external threads and extending to a head portion, wherein the external threads of the compression screw correspond to the internal threads of the compression screw recess, such that the compression screw can be repeatably threadably rotated within the compression screw recess between a retracted position in which the compression screw is positioned within the compression screw recess such that a terminal end of the compression screw does not extend beyond the terminal surface of the at least one projection and an extended position in which the terminal end of the compression screw extends beyond the terminal surface of the at least one projection; and one or more attachment elements, each of the attachment elements having at least one recess bottom wall and at least two recess sidewalls at least partially defining an attachment element recess formed within a portion of each of the one or more attachment elements, wherein a compression screw aperture is formed through the recess bottom wall, wherein if the compression screw is in the retracted position, the attachment element recess is mateable with the at least one projection of the attachment base and wherein if the compression screw recess is aligned with the compression screw aperture, the compression screw is threadedly rotatable to the extended position, wherein at least a portion of the head portion of the compression screw contacts a surface of the recess bottom wall and provides a force to at least a portion of the at least one recess bottom wall to urge the at least two recess sidewalls against the at least two projection sidewalls.

In various exemplary, non-limiting embodiments, the attachment base is in the form of a safety selector core and wherein the at least one attachment element is in the form of safety selector lever members.

In various exemplary, non-limiting embodiments, the attachment base is in the form of a picatinny or other accessory rail compatible base and wherein the at least one attachment element is in the form of a picatinny or other accessory rail compatible attachment element.

In various exemplary, non-limiting embodiments, the attachment base is in the form of a "T" shaped accessory rail compatible base and wherein the at least one attachment element is in the form of a "T" shaped accessory rail compatible attachment element.

In various exemplary, non-limiting embodiments, the at least one projection comprises a substantially dovetail shaped projection, a substantially picatinny shaped projection, or a substantially "T" shaped projection.

In various exemplary, non-limiting embodiments, one of the at least one projections extend from opposing ends of the attachment base.

In various exemplary, non-limiting embodiments, the at least partially internally threaded compression screw recess is centered relative to the terminal surface of the at least one projection.

In various exemplary, non-limiting embodiments, the compression screw aperture is centered relative to the attachment element recess.

In various exemplary, non-limiting embodiments, the compression screw comprises a threaded plug.

In various exemplary, non-limiting embodiments, the one or more attachment elements are each interchangeable relative to the at least one projection of the attachment base.

In various exemplary, non-limiting embodiments, the compression screw aperture includes a tapered portion extending from the attachment element recess, such that at least a head portion of the compression screw is able to be centered relative to the compression screw aperture if the head portion of the compression screw interacts with the tapered portion of the compression screw aperture.

In various exemplary, non-limiting embodiments, an appropriate driver or device is at least partially positionable through the compression screw aperture to interact with the compression screw.

In various exemplary, non-limiting embodiments, the compression screw attachment system of the presently disclosed systems, methods, and/or apparatuses comprises an attachment base having at least one projection extending from the attachment base, wherein the at least one projection comprises at least two projection sidewalls, wherein an at least partially internally threaded compression screw recess extends from a terminal surface of the at least one projection; at least one at least partially externally threaded compression screw, wherein the compression screw can be repeatably threadably rotated within the compression screw recess between a retracted position in which a terminal end of the compression screw does not extend beyond the terminal surface of the at least one projection and an extended position in which the terminal end of the compression screw extends beyond the terminal surface of the at least one projection; and one or more attachment elements, each of the attachment elements having an attachment element recess formed within a portion of each of the one or more attachment elements, wherein at least one recess bottom wall and at least two recess sidewalls at least partially defined the attachment element recess, wherein a compression screw aperture is formed through the recess bottom wall, wherein if the compression screw is in the retracted position, the attachment element recess is slidably mateable with the at least one projection of the attachment base and wherein if the compression screw recess is aligned with the compression screw aperture, the compression screw is threadedly rotatable to the extended position, wherein at least a portion of a head portion of the compression screw contacts a surface of the recess bottom wall and provides a force to at least a portion of the at least one recess bottom wall to urge the at least two recess sidewalls against the at least two projection sidewalls.

In various exemplary, non-limiting embodiments, the compression screw attachment system of the presently disclosed systems, methods, and/or apparatuses comprises an attachment base having a projection having at least two projection sidewalls, wherein an at least partially internally threaded compression screw recess extends from a terminal surface of the projection; at least one at least partially externally threaded compression screw repeatably threadably rotatable within the compression screw recess between a retracted position in which a terminal end of the compression screw does not extend beyond the terminal surface of the projection and an extended position in which the terminal end of the compression screw extends beyond the terminal surface of the projection; and one or more attachment elements, each having an attachment element recess at least partially defined by at least one recess bottom wall and at least two recess sidewalls, wherein a compression screw aperture is formed through the recess bottom wall, wherein if the compression screw is in the retracted position, the attachment element recess is slidably mateable with the projection of the attachment base and wherein if the compression screw recess is aligned with the compression screw aperture, the compression screw is threadedly rotatable to the extended position, wherein at least a portion of a head portion of the compression screw contacts a surface of the recess bottom wall and provides a force to at least a portion of the at least one recess bottom wall to urge the at least two recess sidewalls against the at least two projection sidewalls.

Accordingly, the present disclosure separately and optionally provides an improved attachment system.

The present disclosure separately and optionally provides an improved attachment system that allows attachment elements to be quickly and easily interchangeable relative to an attachment base.

The present disclosure separately and optionally provides a compression screw attachment system that utilizes a compression screw to provide additional tension between opposing surfaces of a dovetail attachment.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the disclosure discussed herein. In similar fashion, while exemplary embodiments may be discussed below as device, system, or method embodiments, it is to be understood that such exemplary embodiments can be implemented in various devices, systems, and methods of the present disclosure.

BRIEF DESCRIPTION OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE DISCLOSURE

Figure 1:
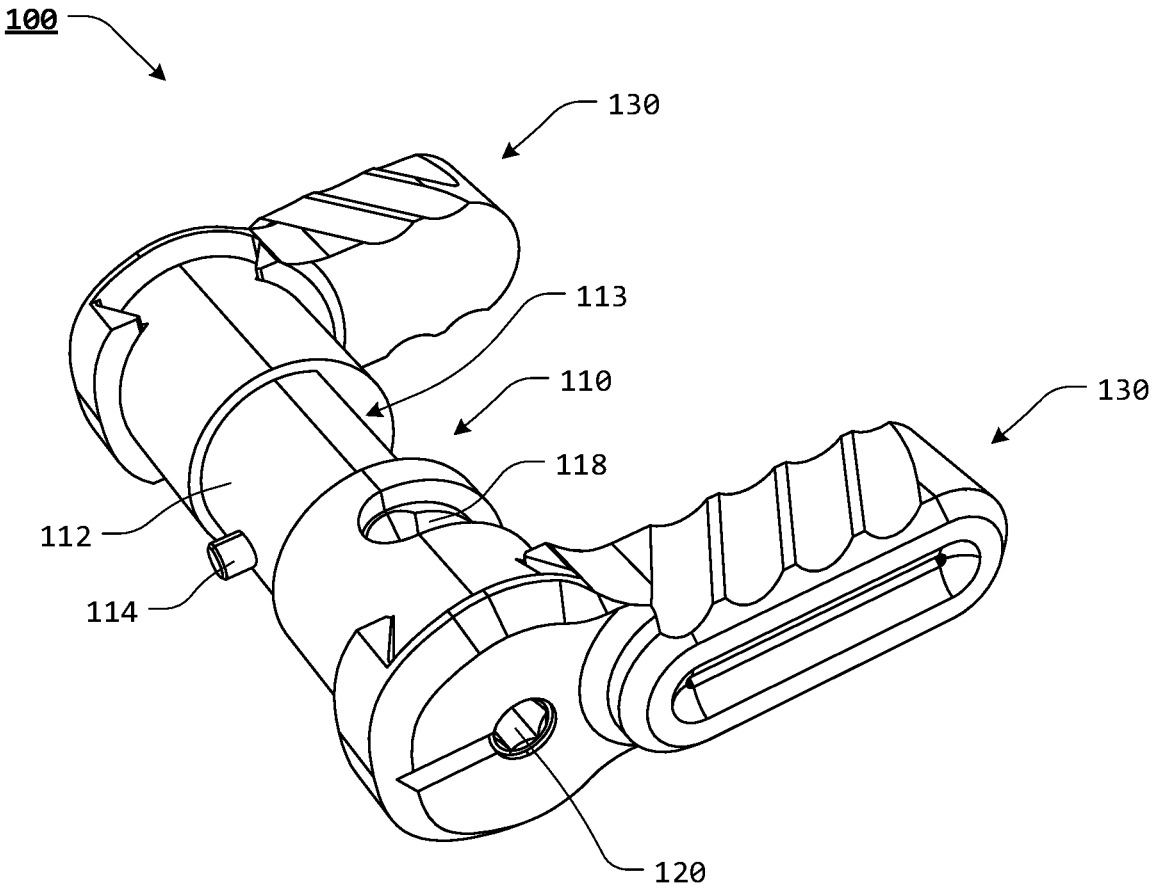
FIG. 1 illustrates a perspective view of an exemplary embodiment of a compression screw attachment system according to the present disclosure.
Figure 2:
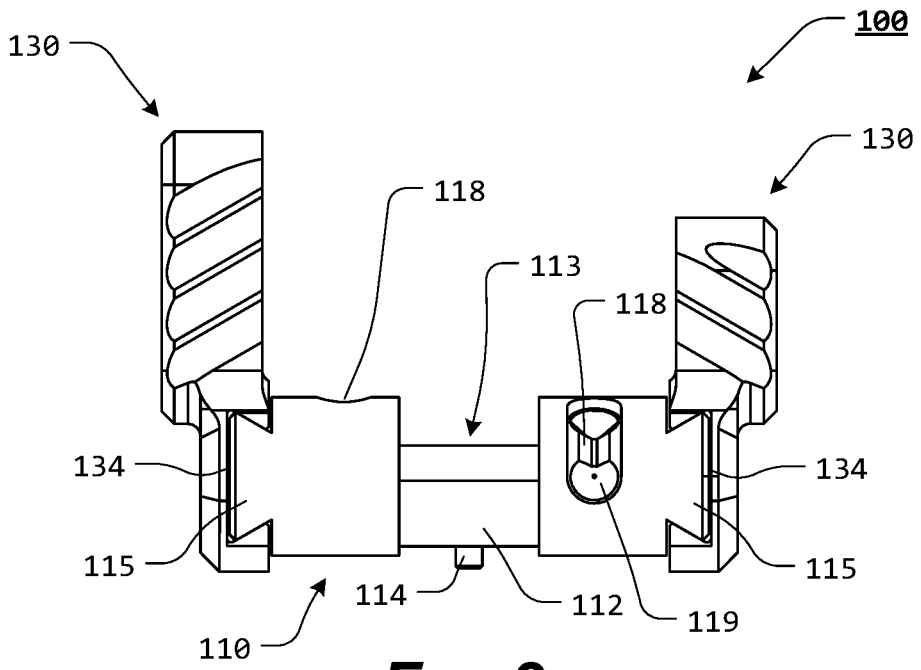
FIG. 2 illustrates a top view of an exemplary embodiment of a compression screw attachment system according to the present disclosure.
Figure 3:
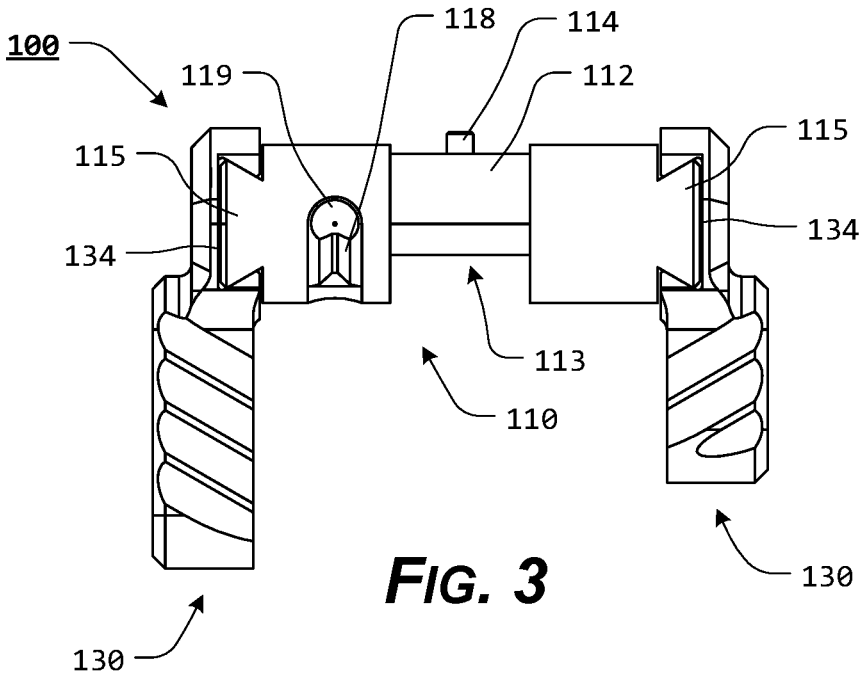
FIG. 3 illustrates a bottom view of an exemplary embodiment of a compression screw attachment system according to the present disclosure.

The foregoing and other objectives, features, and advantages of the invention will be more readily understood upon consideration of the following description of the invention taken in conjunction with the accompanying drawings.

For simplicity and clarification, the design factors and operating principles of the compression screw attachment system according to the present disclosure are explained with reference to various exemplary embodiments of compression screw attachment system according to the present disclosure. The basic explanation of the design factors and operating principles of the compression screw attachment system is applicable for the understanding, design, and operation of the compression screw attachment system of the present disclosure. It should be appreciated that the compression screw attachment system can be adapted to many applications where a safety selector lever or an attachment system is necessary or desirable.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "compression screw", "attachment base", "attachment element", and "firearm" are used for basic explanation and understanding of the operation of the systems, methods, and apparatuses of the present disclosure. Therefore, the terms "compression screw", "attachment base", "attachment element", and "firearm" are not to be construed as limiting the systems, methods, and apparatuses of the present disclosure.

For simplicity and clarification, the compression screw attachment system of the present disclosure will be described as being used in connection with a safety selector lever for an AR-15 or M4 style firearm. However, it should be appreciated that these are merely exemplary embodiments of the compression screw attachment system and are not to be construed as limiting the present disclosure. Thus, the compression screw attachment system of the present disclosure may be utilized in connection with any firearm or other device and may be utilized to attach or couple elements together.

Figure 4:
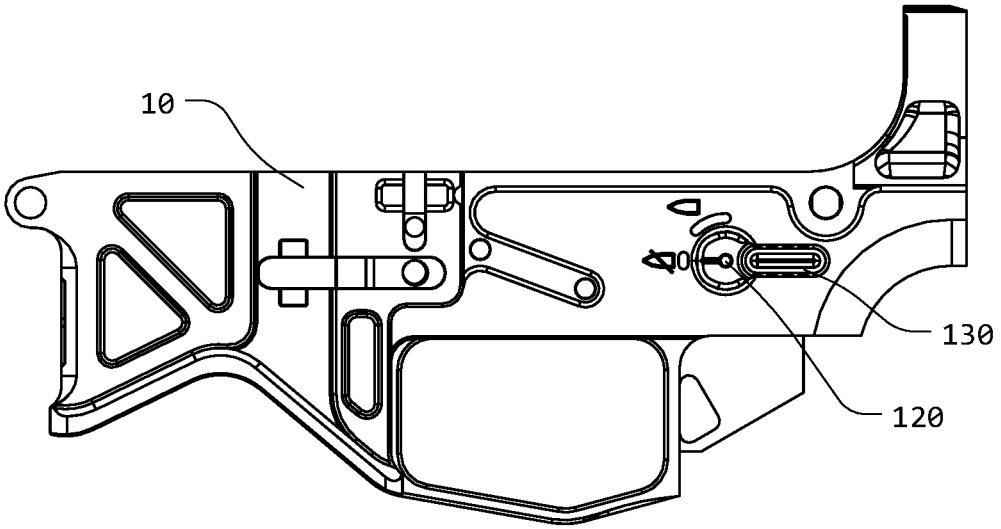
FIG. 4 illustrates a side view of a portion of an exemplary lower receiver of an AR-15 or M4 style firearm showing an exemplary compression screw attachment system of the present disclosure in the "SAFE" position.
Figure 5:
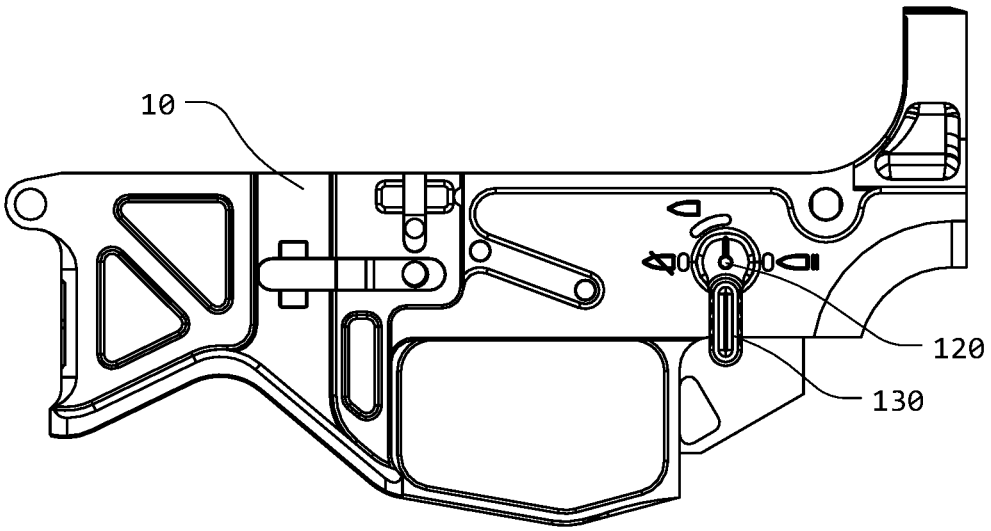
FIG. 5 illustrates a side view of a portion of an exemplary lower receiver of an AR-15 or M4 style firearm showing an exemplary compression screw attachment system of the present disclosure in the "FIRE" position.
Figure 6:
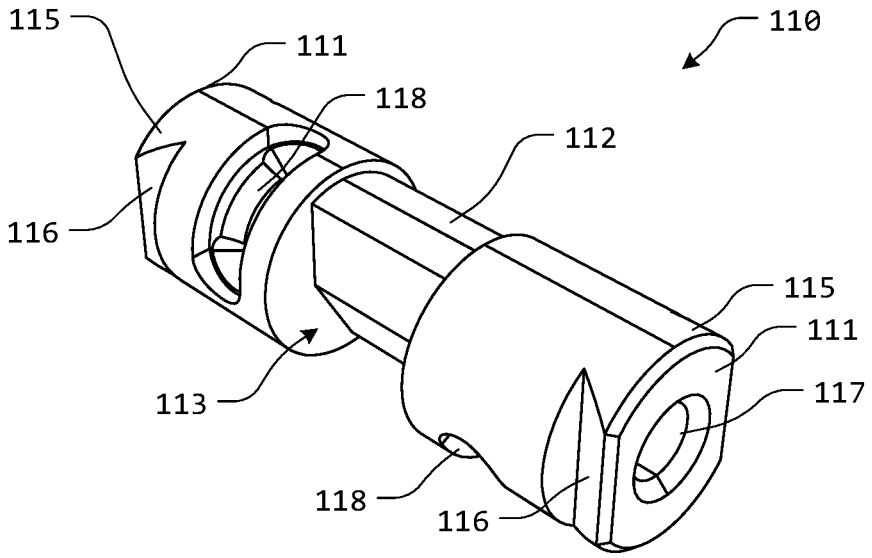
FIG. 6 illustrates an perspective view of an attachment base according to an exemplary embodiment of the present disclosure.
Figure 7:
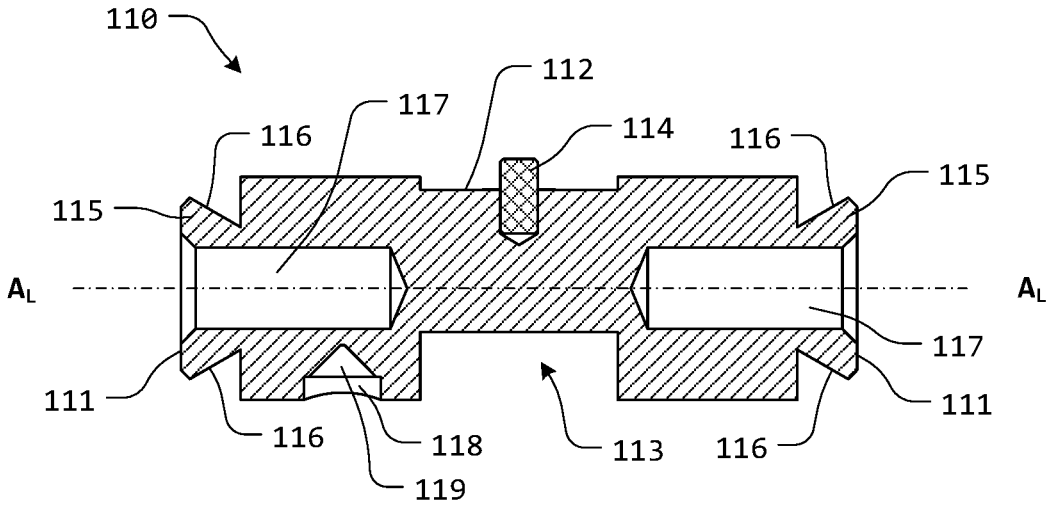
FIG. 7 illustrates a cross-sectional view of an attachment base according to an exemplary embodiment of the present disclosure.
Figure 8:
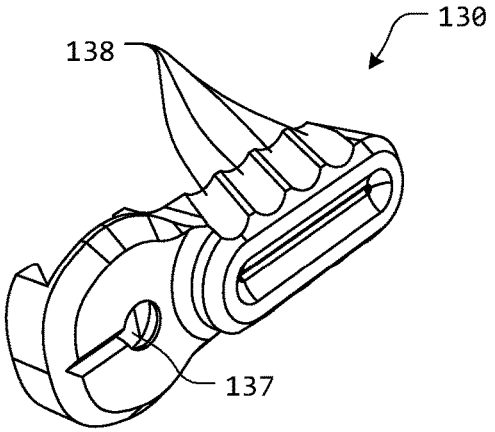
FIG. 8 illustrates a perspective view of an attachment element according to an exemplary embodiment of the present disclosure.
Figure 9:
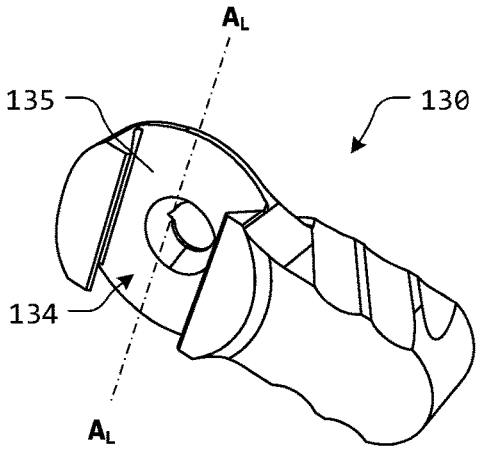
FIG. 9 illustrates a perspective view of an attachment element according to an exemplary embodiment of the present disclosure.
Figure 10:
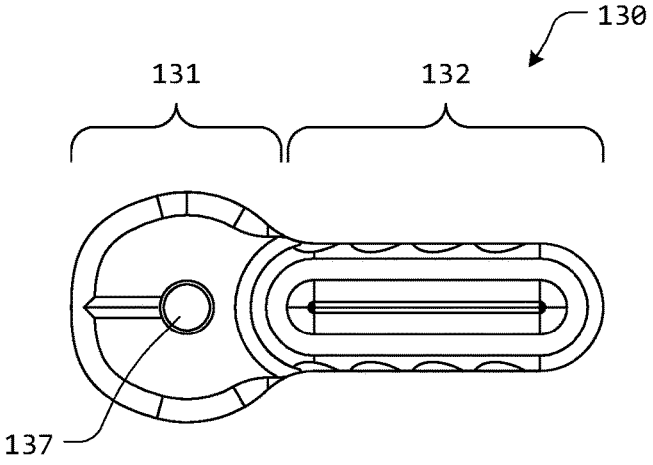
FIG. 10 illustrates a side view of an attachment element according to an exemplary embodiment of the present disclosure.
Figure 11:
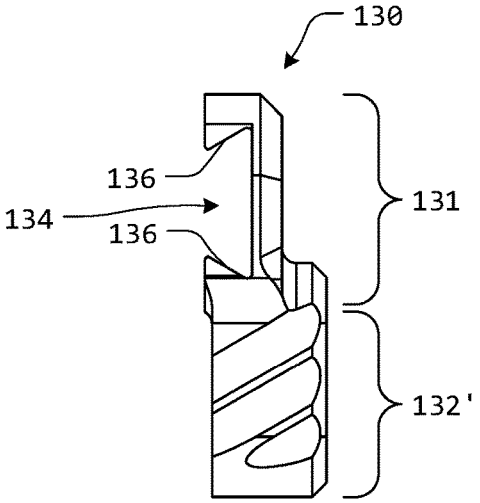
FIG. 11 illustrates a top view of an attachment element according to an exemplary embodiment of the present disclosure.
Figure 12:
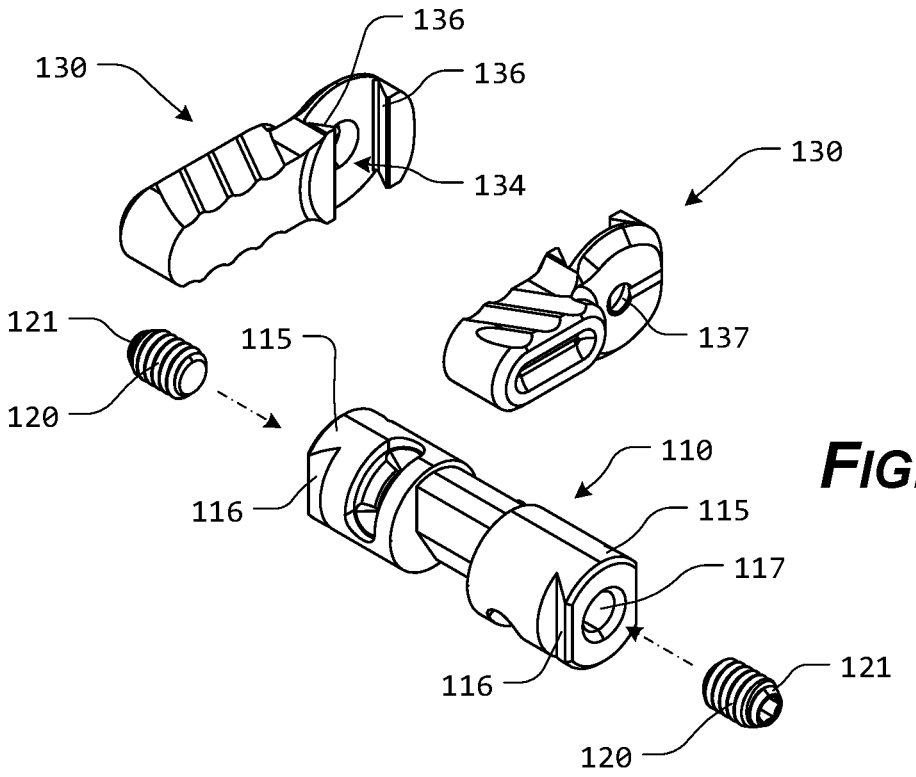
FIG. 12 illustrates an exploded, perspective view of an exemplary compression screw attachment system according to an exemplary embodiment of the present disclosure.
Figure 13:
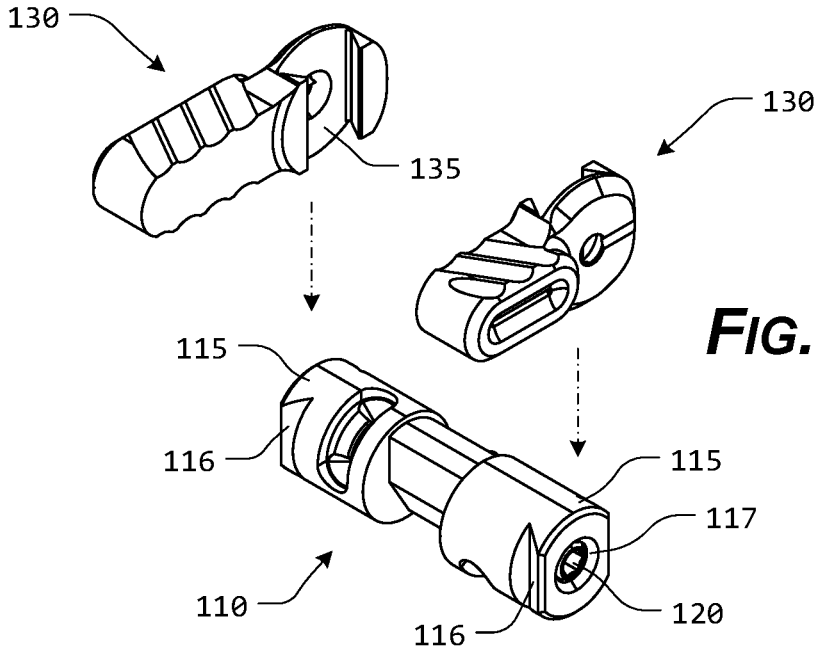
FIG. 13 illustrates an exploded, perspective view of a partially assembled exemplary compression screw attachment system according to an exemplary embodiment of the present disclosure.
Figure 14:
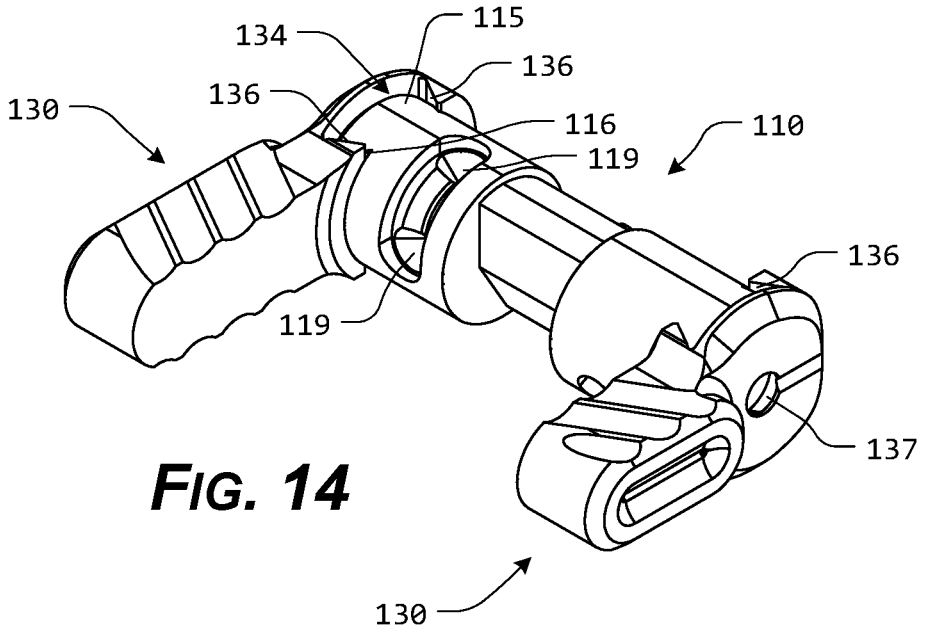
FIG. 14 illustrates a perspective view of a partially assembled exemplary compression screw attachment system according to an exemplary embodiment of the present disclosure.
Figure 15:
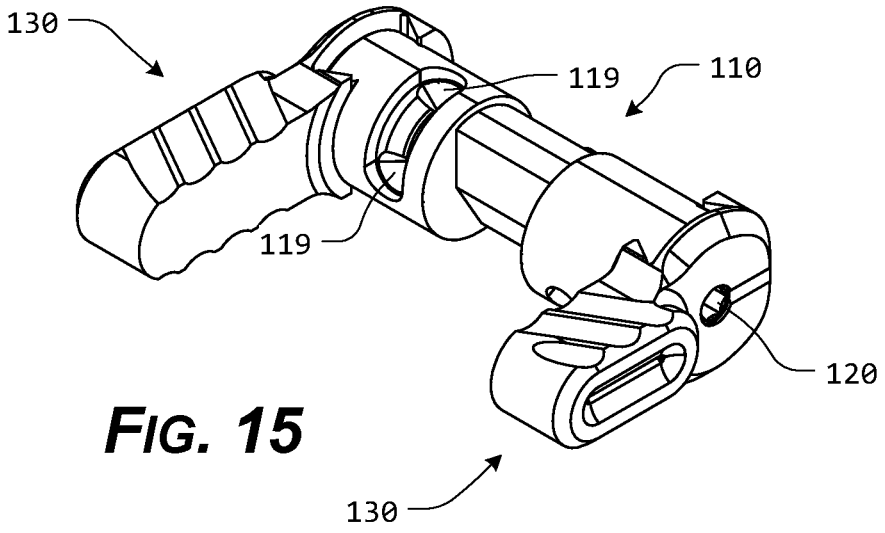
FIG. 15 illustrates a perspective view of an assembled exemplary compression screw attachment system according to an exemplary embodiment of the present disclosure.
Figure 16:
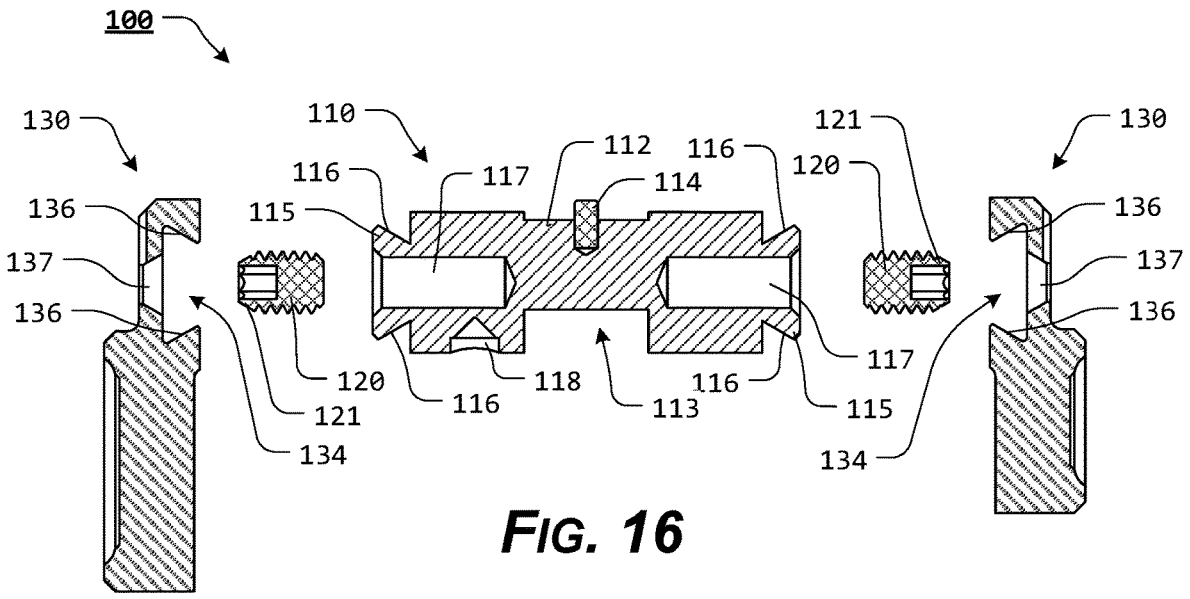
FIG. 16 illustrates a top, exploded, cross-sectional view of an exemplary compression screw attachment system according to an exemplary embodiment of the present disclosure.
Figure 17:
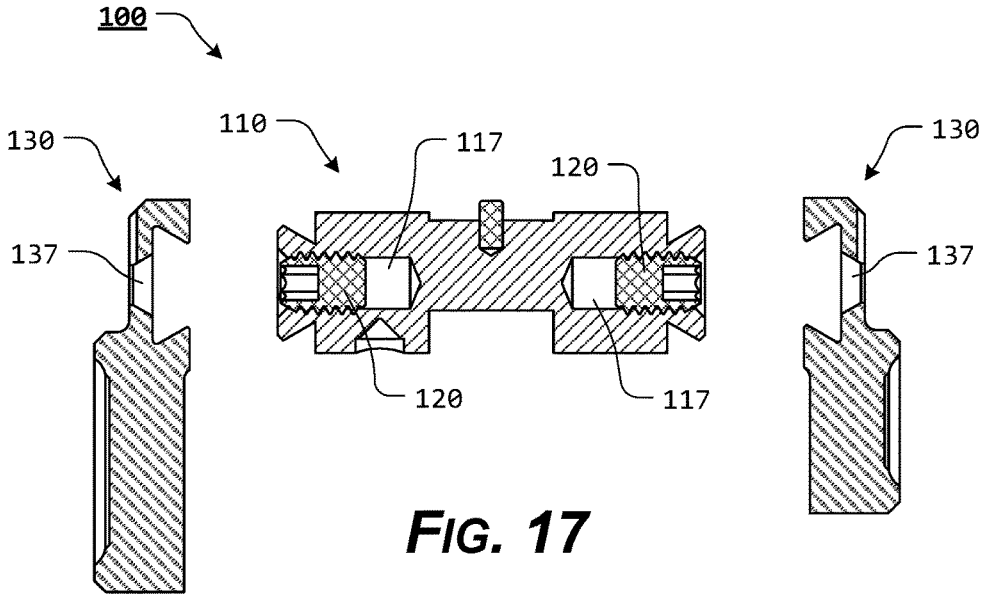
FIG. 17 illustrates a top, exploded, cross-sectional view of a partially assembled exemplary compression screw attachment system according to an exemplary embodiment of the present disclosure.
Figure 18:
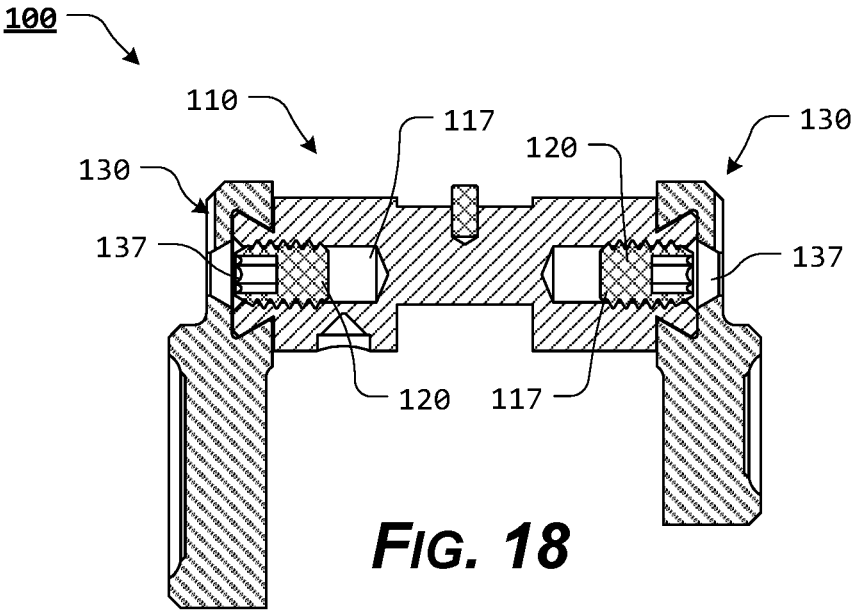
FIG. 18 illustrates a top, cross-sectional view of a partially assembled exemplary compression screw attachment system according to an exemplary embodiment of the present disclosure.
Figure 19:
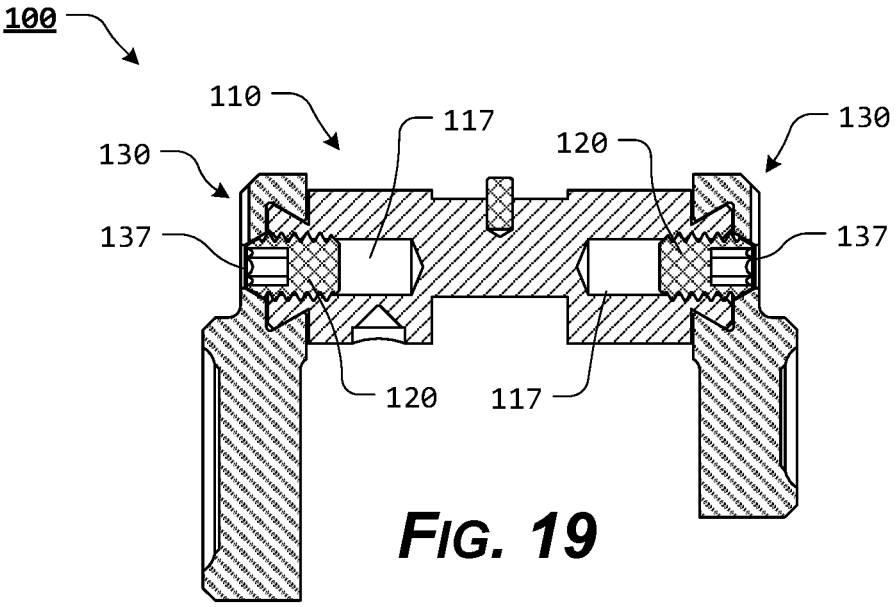
FIG. 19 illustrates a top, cross-sectional view of an assembled exemplary compression screw attachment system according to an exemplary embodiment of the present disclosure.
Figure 20:
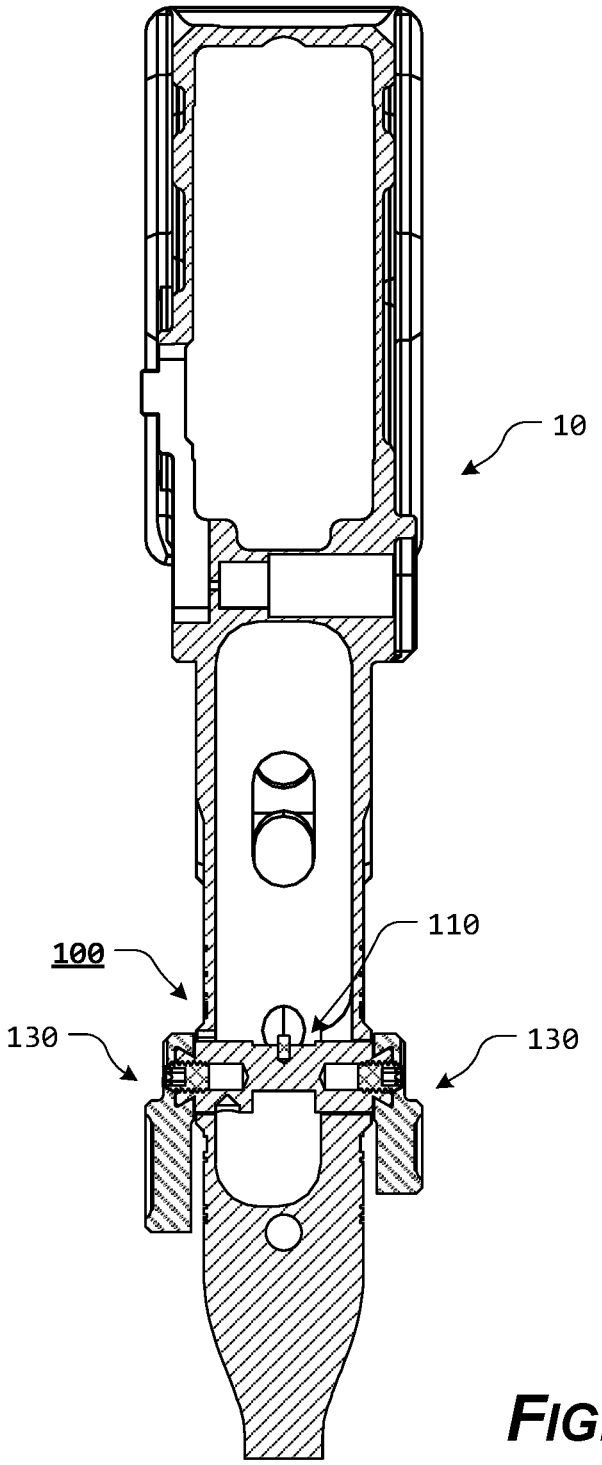
FIG. 20 illustrates a top, cross-sectional view of a portion of an exemplary lower receiver of an AR-15 or M4 style firearm including an exemplary compression screw attachment system of the present disclosure.
Figure 21A:
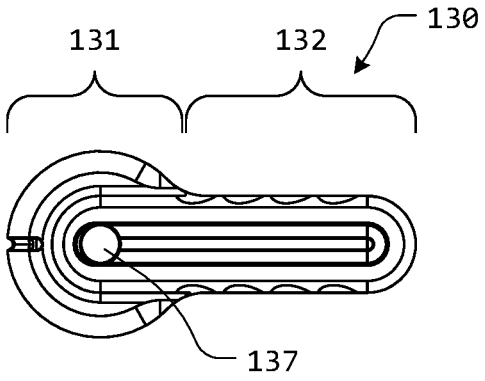
FIG. 21A illustrates a side view of an exemplary safety selector lever according to an exemplary embodiment of the present disclosure.
Figure 21B:
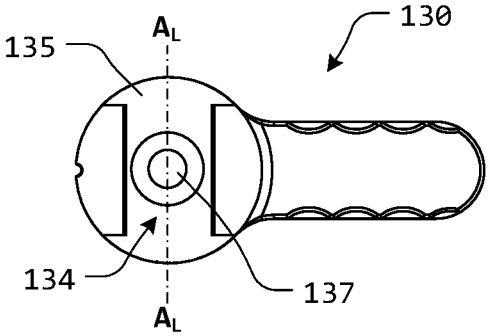
FIG. 21B illustrates a side view of an exemplary safety selector lever according to an exemplary embodiment of the present disclosure.
Figure 21C:
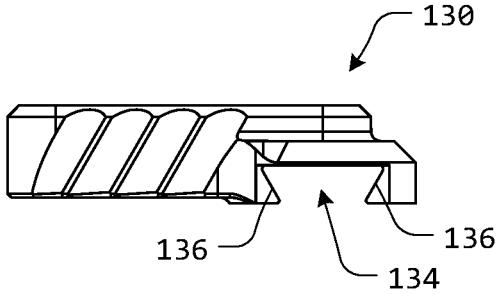
FIG. 21C illustrates a top view of an exemplary safety selector lever according to an exemplary embodiment of the present disclosure.
Figure 21D:
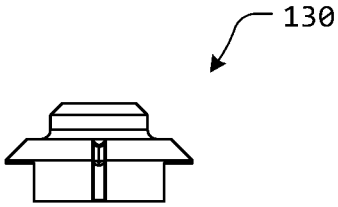
FIG. 21D illustrates a front view of an exemplary safety selector lever according to an exemplary embodiment of the present disclosure.
Figure 21E:
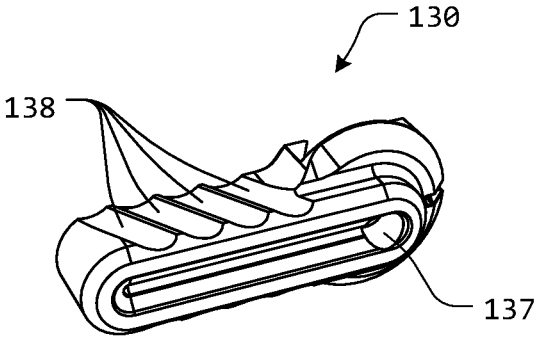
FIG. 21E illustrates a side, perspective view of an exemplary safety selector lever according to an exemplary embodiment of the present disclosure.
Figure 21F:
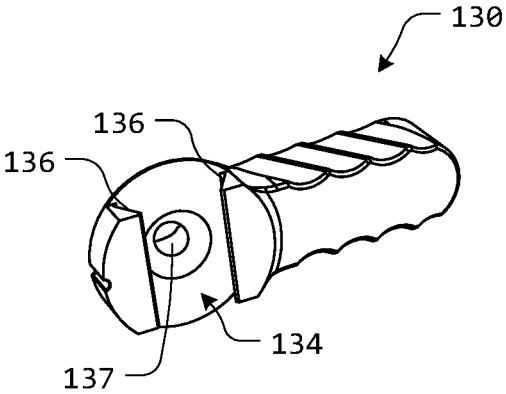
FIG. 21F illustrates a side, perspective view of an exemplary safety selector lever according to an exemplary embodiment of the present disclosure.
Figure 22A:
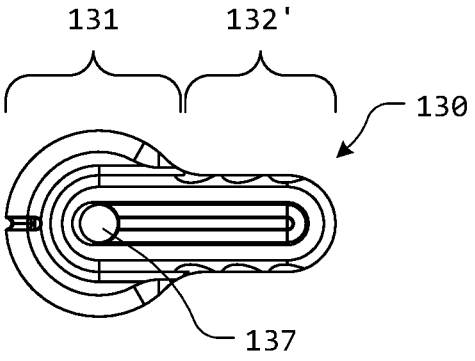
FIG. 22A illustrates a side view of an exemplary safety selector lever according to an exemplary embodiment of the present disclosure.
Figure 22B:
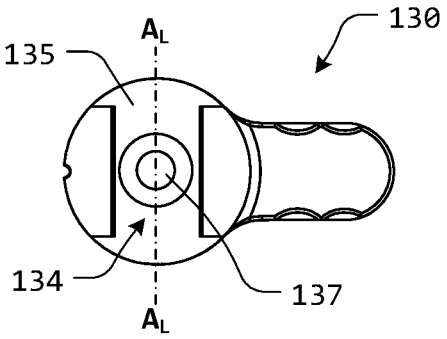
FIG. 22B illustrates a side view of an exemplary safety selector lever according to an exemplary embodiment of the present disclosure.
Figure 22C:
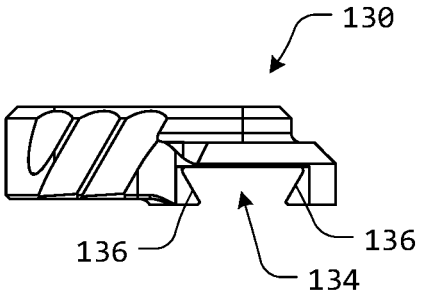
FIG. 22*c* illustrates a top view of an exemplary safety selector lever according to an exemplary embodiment of the present disclosure.
Figure 22D:
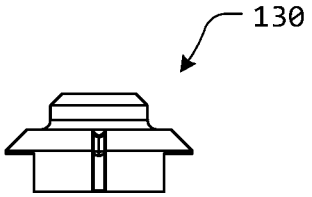
FIG. 22D illustrates a front view of an exemplary safety selector lever according to an exemplary embodiment of the present disclosure.
Figure 22E:
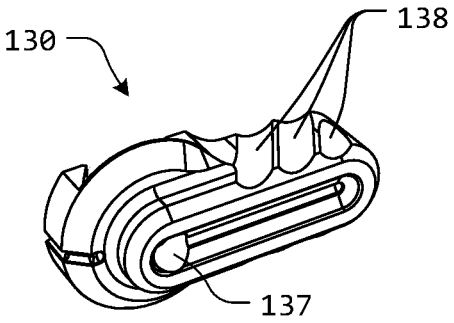
FIG. 22E illustrates a side, perspective view of an exemplary safety selector lever according to an exemplary embodiment of the present disclosure.
Figure 22F:
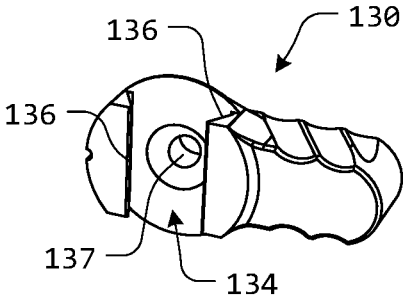
FIG. 22F illustrates a side, perspective view of an exemplary safety selector lever according to an exemplary embodiment of the present disclosure.
Figure 23:
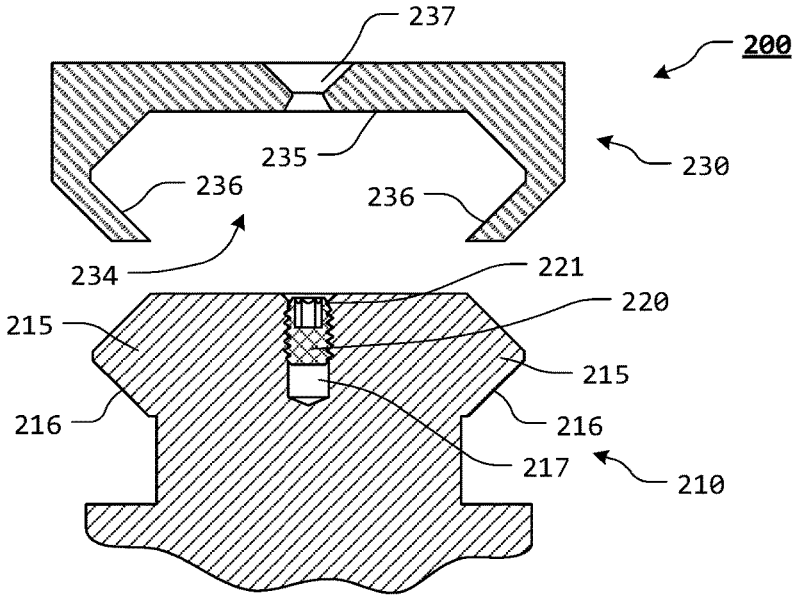
FIG. 23 illustrates a front, cross-sectional view of certain components of an exemplary embodiment of a compression screw attachment system according to the present disclosure.
Figure 24:
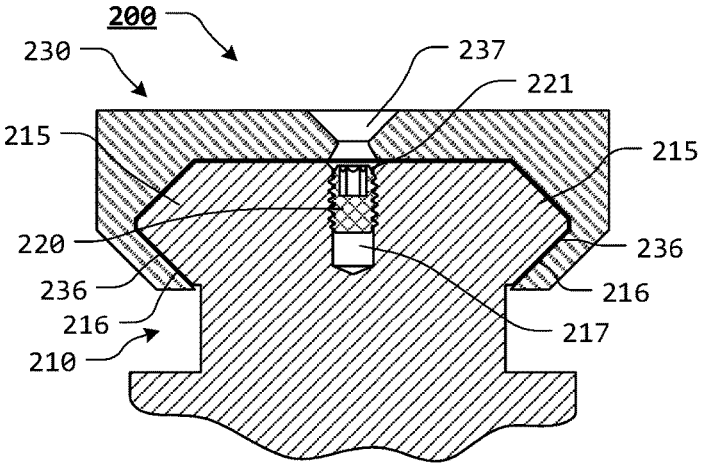
FIG. 24 illustrates a front, cross-sectional view of partially assembled components of an exemplary embodiment of a compression screw attachment system according to the present disclosure.
Figure 25:
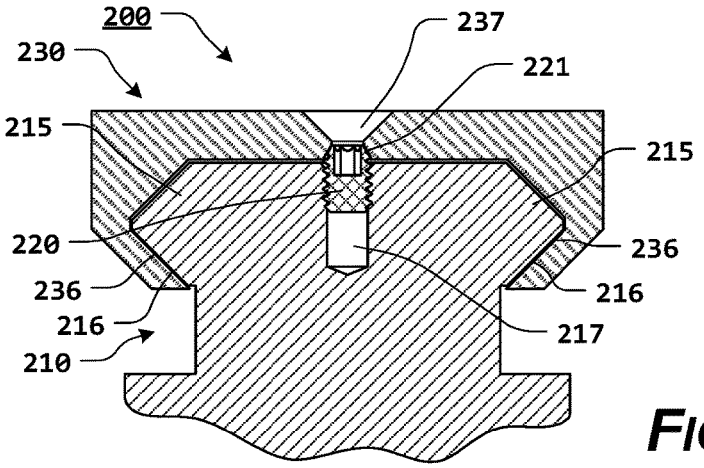
FIG. 25 illustrates a front, cross-sectional view of assembled components of an exemplary embodiment of a compression screw attachment system according to the present disclosure.
Figure 26:
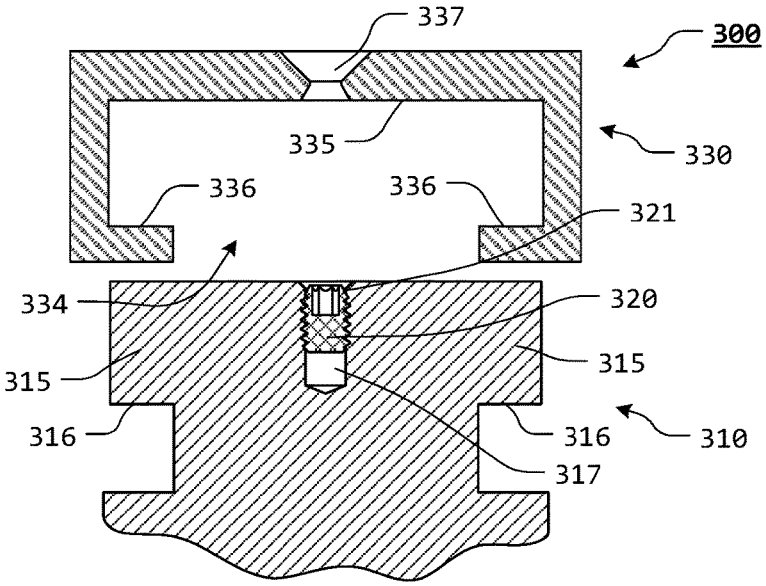
FIG. 26 illustrates a front, cross-sectional view of certain components of an exemplary embodiment of a compression screw attachment system according to the present disclosure.
Figure 27:
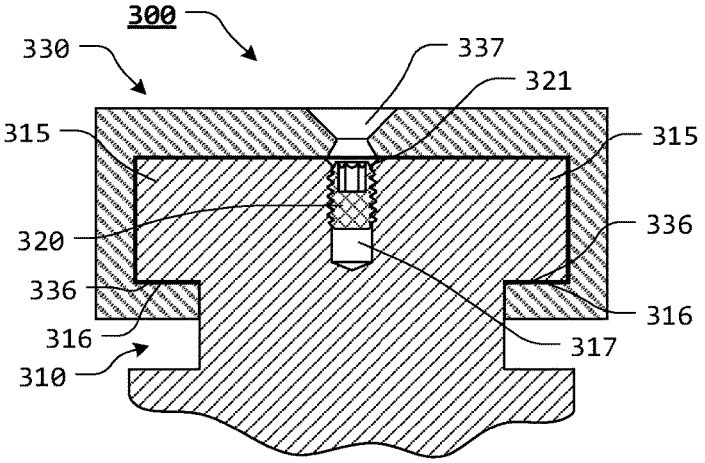
FIG. 27 illustrates a front, cross-sectional view of partially assembled components of an exemplary embodiment of a compression screw attachment system according to the present disclosure.
Figure 28:
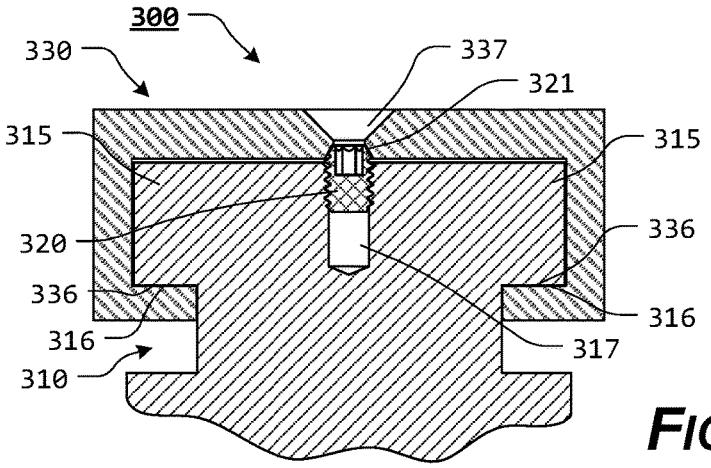
FIG. 28 illustrates a front, cross-sectional view of assembled components of an exemplary embodiment of a compression screw attachment system according to the present disclosure.

In the form of the present disclosure chosen for purposes of illustration, FIGS. 1-22F illustrate various exploded, partially exploded, and/or assembled views of the exemplary components of the compression screw attachment system 100. FIGS. 4-5 and 20 illustrate various views of the exemplary components of the compression screw attachment system 100, attached or coupled to an exemplary lower receiver 10 of an exemplary firearm, while FIGS. 1-3, 6-19, and 21A-22F illustrate various views of the exemplary components of the compression screw attachment system 100, removed from an exemplary lower receiver 10 of an exemplary firearm. Additionally, FIGS. 23-25 illustrate various exploded, partially exploded, and/or assembled views of the exemplary components of the compression screw attachment system 200, while FIGS. 26-28 illustrate various exploded, partially exploded, and/or assembled views of the exemplary components of the compression screw attachment system 300.

In illustrative, non-limiting embodiment(s) of the present disclosure, as illustrated in FIGS. 1-22F, the compression screw attachment system 100 comprises at least some of an attachment base 110 (in the form of a safety selector core), one or more compression screws 120, and one or more attachment elements 130 (in the form of safety selector lever member attachment elements).

In various exemplary embodiments, the attachment base 110 extends between opposing ends 111 and includes at least one lock portion 112 and at least one recess portion 113 formed between the opposing ends 111. If/when the compression screw attachment system 100 is mounted in a lower receiver 10, as illustrated, for example, in FIGS. 4-5 and 20, the compression screw attachment system 100 is rotatable between a "SAFE" position, as shown in FIGS. 4 and 20, and a "FIRE" position, as shown in FIG. 5.

When the attachment base 110 is in the "SAFE" position, the lock portion 112 of the attachment base 110 protrudes into the path of a movable member of the firearm's firing mechanism, such as a portion of the trigger or the hammer, not shown. However, when the attachment base 110 is rotated to the "FIRE" position, the recess 113 is positioned to allow free movement of the firing mechanism.

In various exemplary, nonlimiting embodiments, the attachment base 110 is in the form of a safety selector core includes an alignment pin 114 that can allow the attachment base 110 to only be used with certain firearms having an appropriate keyway to allow the attachment base 110, having the alignment pin 114, to be installed in the firearm.

A detent recess 118 is formed in a portion of the attachment base 110. The detent recess 118 is capable of interacting with a detent of the firearm to limit rotational movement of the compression screw attachment system 100. In various exemplary embodiments, the detent recess 118 is formed to provide 90° of rotational movement of the attachment base 110, about the longitudinal axis, $A_L$, of the attachment base 110 (with detented stop points 119 at 0° and) 90°. Thus, utilizing the attachment base 110, an attachment element 130, for example, as illustrated in FIGS. 4-5, is only rotatable 90° (θ) to move from the "SAFE" position to the "FIRE" position. In certain exemplary embodiments, the detent recess 118 is formed in the attachment base 110 is formed so as to provide 50° of rotational movement of the attachment base 110, with detented stop points 119 at 0° and 50°. Alternatively, the detent recess 118 may provide for 180° of rotation, with optional detented stop points 119 at 0°, 50°, and 180°. It should be appreciated that by altering the length of the detent recess 118 and/or the placement of detented stop points 119 within the detent recess 118, the degree of rotation (θ) for the attachment element can be altered.

A projection 115 is formed proximate or in each opposing end 111 of the attachment base 110. In various exemplary embodiments, as illustrated, the projection 115 has projection side walls 116, forming a substantially dovetailed cross-section. Thus, each opposing end 111 of the attachment base 110 includes a substantially dovetail shaped projection 115, having projection side walls 116.

A compression screw recess 117 extends from one or both of the opposing ends 111 of the attachment base 110 and is centered relative to the projection 115. Each compression screw recess 117 is at least partially internally threaded. The internal threading of each compression screw recess 117 is formed so as to allow interaction between the internal threads of the compression screw recess 117 and external threads of a compression screw 120, such that the compression screw 120 can be repeatably threadably rotated between a retracted position (as illustrated, for example, in FIGS. 14, 17, and 18) and an extended position (as illustrated, for example, in FIGS. 15 and 19). Each compression screw recess 117 extends so as to allow an entire compression screw 120 to be received therein, such that when the compression screw 120 is in a retracted position, a terminal end of the head portion 121 of the compression screw 120 is substantially flush with a terminal surface of the opposing end 111 and does not extend beyond the terminal end of the opposing end 111 of the attachment base 110.

In various exemplary embodiments, each compression screw 120 is similar to a threaded head plug. In various exemplary embodiments, each compression screw 120 comprises a hex head socket threaded plug. It should be appreciated that other threaded plugs may be utilized, but by utilizing a compression screw 120 similar to a hex head socket threaded plug, a hex key, Allen key, or other similar device can be positioned through the compression screw apertures 137 and be used to engage and rotate the compression screw 120.

Each compression screw 120 includes a head portion 121. In various exemplary embodiments, the head portion 121 of each compression screw 120 is partially tapered, so as to allow at least a head portion 121 of the compression screw 120 to be centered, when positioned at least partially within a compression screw aperture 137 of an attachment element 130.

As illustrated in FIGS. 1-22F the attachment elements 130 take the form of safety selector lever members. In these exemplary embodiments, each of the attachment elements 130 includes a head portion 131 and an extension portion 132 or 132'. In various exemplary embodiment, as illustrated, an extension portion 132 or 132' can be provided. As illustrated most clearly in FIGS. 8-11, FIGS. 21A-21F, and 22A-22F, the extension portion 132 may be longer than the extension portion 132'. It should also be appreciated that the extension portion 132 or 132' may include different features, when compared to one another. For example, by altering the length, thickness, or configuration of the extension portion 132 and/or 132', a user may select attachment elements 130 that are most satisfactory to the shooter. Thus, a plurality of interchangeable attachment elements 130 may be provided and a desired attachment element 130 may be mounted on each projection 115 of the attachment base 110. Furthermore, the attachment element 130 that is chosen to be attached or coupled to one opposing end 111 of the attachment base 110 may or may not match the attachment element 130 that is attached or coupled to the other opposing end 111 of the attachment base 110.

An attachment element recess 134 is formed within a portion of the head portion 131 of each attachment element 130. The attachment element recess 134 includes a recess bottom wall 135 and recess sidewalls 136, defining at least a portion of the attachment element recess 134. At least a portion of the attachment element recess 134 is formed so as to slidably or otherwise mateable with portions of the projections 115 of the attachment base 110.

In this manner, interaction between the attachment element recess 134 and the projection 115 ensure that the attachment element 130 is rotated with the attachment base 110. Thus, the interaction of the projection 115 and the attachment element recess 134 ensure that the attachment base 110 and the attachment element 130 do not rotate separate or apart from one another and rotational movement of the attachment element 130 is transmitted directly to the attachment base 110.

A compression screw aperture 137 is formed through the recess bottom wall 135 of the attachment element 130. Typically, the compression screw aperture 137 is formed within the head portion 131 and is centered relative to the attachment element recess 134. In various exemplary embodiments, the compression screw aperture 137 includes a tapered portion as the compression screw aperture 137 extends from the attachment element recess 134. In this manner, the head portion 121 of the compression screw 120 is able to be centered relative to the compression screw aperture 137 if/when the head portion 121 of the compression screw 120 interacts with the tapered portion of the compression screw aperture 137.

When the compression screw recess 117 is centered relative to the projection 115 and the compression screw aperture 137 is centered relative to the attachment element recess 134, when the attachment element 130 is positioned relative to the attachment base 110, such that the attachment element recess 134 is appropriately mated with the projection 115, the compression screw recess 117 is aligned with the compression screw aperture 137. Thus, a hex key (or other appropriate driver or device) is capable of being positioned through the compression screw aperture 137 to interact with the compression screw 120. Furthermore, when the compression screw 120 is rotated to or toward the extended position, the head portion 121 of the compression screw 120 engages the compression screw aperture 137 to, among other things, maintain an appropriately aligned positioned between the attachment base 110 and the attachment element 130 and resists slidable movement of the attachment element 130 relative to the attachment base 110.

In various exemplary embodiments, a plurality of diagonal grooves 138 are formed within a portion of the extension portion 132 or 132' of the attachment element 130. The grooves 138, if included, serve to prevent the user's finger from slipping off the extension portion 132 or 132' of the attachment element 130.

During assembly of the compression screw attachment system 100, as illustrated most clearly in FIGS. 12-19, the compression screws 120 are initially threadedly inserted within the compression screw recesses 117. Each compression screw 120 is threadedly inserted within the compression screw recess 117 and rotated (typically clockwise) so as to be in the retracted position (as illustrated, for example, in FIGS. 14, 17, and 18), with the terminal end of the head portion 121 positioned flush or below the corresponding opposing end 111 of the attachment base 110. In this manner, the compression screw 120 does not interfere with the ability of the attachment element 130 to be slidably attached to the attachment base 110, via interaction of the projection 115 and the attachment element recess 134.

Once the compression screw 120 is appropriately positioned within the compression screw recess 117, the attachment element 130 is appropriately positioned relative to the attachment base 110, via slidable interaction of the projection 115 and the attachment element recess 134. The attachment element 130 is appropriately positioned such that the hex recess (or other head preparation) of the compression screw 120 is accessible through the compression screw aperture 137.

The hex key (or other appropriate driver or device) is positioned through the compression screw aperture 137, so as to interact with the hex recess (or other head preparation). The hex key is then rotated (typically counterclockwise) to rotate the compression screw 120 toward the extended position. As the compression screws 120 continues to be rotated toward the extended position, the head portion 121 of the compression screw 120 will contact and interact with at least a portion of the compression screw aperture 137.

As the compression screw 120 is rotated further toward the extended position, the head portion 121 of the compression screw 120 will be urged against the recessed portion or other portion of the compression screw aperture 137 and urged the attachment element 130 away from the attachment base 110, along the longitudinal axis, $A_L$, of the attachment base 110.

By urging the attachment element 130 away from the attachment base 110, the compression screw 120 is placed under compression and the recess side walls 136 of the attachment element 130 are urged against the projection side walls 116 of the attachment base 110. By urging the recess sidewalls 136 against the projection sidewalls 116, the attachment element 130 is further secured or attached to the attachment base 110. Because the compression screw 120 is placed under a compressional force (as opposed to the typical tension force that is placed on portions of a typical attachment screw), greater forces can be exerted to urge the recess sidewalls 136 against the projection sidewalls 116, when compared to the amount of force provided by typical intentional attachment, via a typical attachment screw. Thus, the compression screw attachment system 100 provides improved attachment or coupling between the attachment base 110 and the attachment elements 130.

Additionally, when the compression screw 120 is rotated to or toward the extended position, the head portion 121 of the compression screw 120 engages the compression screw aperture 137 to further assist in maintaining an appropriately aligned positioned between the attachment base 110 and the attachment element 130 and resist slidable movement of the attachment element 130 relative to the attachment base 110.

In this manner, an attachment element 130 may be attached or coupled to each of the opposing ends 111 of the attachment base 110.

If a user desires to remove and/or replace an attachment element 130, the compression screw 120 is rotated from the extended position to the retracted position. Once the compression screw 120 is in the retracted position, the attachment element 130 can be slidably removed from the attachment base 110 and replaced, if desired, by an alternate attachment element 130.

In various exemplary embodiments, various components of the compression screw attachment system 100 are substantially rigid and are formed of stainless steel. Alternate materials of construction of the various components of the compression screw attachment system 100 may include one or more of the following: steel, aluminum, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the compression screw attachment system 100 is a design choice based on the desired appearance and functionality of the compression screw attachment system 100.

It should be appreciated that certain elements of the compression screw attachment system 100 may be formed as an integral unit (such as, for example, the attachment base 110 and one or more of the attachment elements 130). Alternatively, suitable materials can be used and sections or elements made independently and attached or coupled together, such as by adhesives, welding, screws, rivets, pins, or other fasteners, to form the various elements of the compression screw attachment system 100.

It should also be understood that the overall size and shape of the compression screw attachment system 100 and the various portions thereof, the attachment base 110, and the attachment elements 130, is a design choice based upon the desired functionality and/or appearance of the compression screw attachment system 100.

It should also be appreciated that a more detailed explanation of the specific dimensions of certain components of the compression screw attachment system 100, instructions regarding how to install the compression screw attachment system 100, methods for using the compression screw attachment system 100, once installed, and certain other items and/or techniques necessary for the implementation and/or operation of the various exemplary embodiments of the present disclosure are not provided herein because such background information will be known to one of ordinary skill in the art. Therefore, it is believed that the level of description provided herein is sufficient to enable one of ordinary skill in the art to understand and practice the systems, methods, and apparatuses of the presentation, as described.

It should be appreciated that the compression screw attachment system of the present disclosure is not limited to the embodiment illustrated and described as the compression screw attachment system 100. For example, FIGS. 23-25 illustrate an exemplary embodiment of a compression screw attachment system 200. The compression screw attachment system 200 comprises at least some of a projection 215 having one or more projection side walls 216, one or more compression screw recesses 217, and one or more compression screws 220, each having a head portion 221.

It should be appreciated that these elements correspond to and operate similarly to the projection 115 having the one or more projection side walls 116, the one or more compression screw recesses 117, and the one or more compression screws 120, each having the head portion 121, as described, with reference to compression screw attachment system 100.

However, as illustrated FIGS. 23-25, the attachment base 110 (in the form of a safety selector core) having opposing ends 111 is replaced by an attachment base 210 (in the form of a picatinny or other accessory rail compatible base) having a top portion 211. The substantially dovetail projection 115 of the compression screw attachment system 100 is replaced by a substantially picatinny shaped or other accessory rail projection 215 having projection side walls 216 and the attachment element recess 134 is replaced by a correspondingly shaped attachment element recess 234 having a recess bottom wall 235 and recess side walls 236.

Additionally, the one or more safety selector lever member attachment elements 130 are replaced by a picatinny or other accessory rail compatible attachment elements 230. The attachment element 230 may comprise a portion of a scope or optic mount, a sight, a flashlight or illumination device, a laser emitter, a grip portion, a handgrip, a hand stop, a bipod, a camera, a sling mount, a bayonet, or any other device that can be attached or coupled to a picatinny or other accessory rail.

The attachment element 230 includes an attachment element recess 234, defined by a recess bottom wall 235 and one or more recess side walls 236. A compression screw aperture 237 is formed proximate a center (or centered along a longitudinal axis, $A_L$) of the attachment element recess 234. While formed in an attachment element 230, the attachment element recess 234, recess sidewalls 236 and compression screw aperture 237 correspond to and operate similarly to the attachment element recess 134, recess sidewalls 136, and compression screw aperture 137 of the compression screw attachment system 100.

During assembly of the compression screw attachment system 200, as illustrated most clearly in FIGS. 23-25, the compression screw 220 is initially threadedly inserted within the compression screw recesses 217. The compression screw 220 is threadedly inserted within the compression screw recess 217 and rotated (typically clockwise) so as to be in the retracted position (as illustrated, for example, in FIGS. 23 and 24), with the terminal end of the head portion 221 positioned flush or below a terminal surface of the top portion 211 of the attachment base 210. In this manner, the compression screw 220 does not interfere with the ability of the attachment element 230 to be slidably attached to the attachment base 210, via interaction of the projection 215 and the attachment element recess 234.

Once the compression screw 220 is appropriately positioned within the compression screw recess 217, the attachment element 230 is appropriately positioned relative to the attachment base 210, via slidable interaction of the projection 215 and the attachment element recess 234. The attachment element 230 is appropriately positioned such that the hex recess (or other head preparation) of the compression screw 220 is accessible through the compression screw aperture 237.

The hex key (or other appropriate driver or device) is positioned through the compression screw aperture 237, so as to interact with the hex recess (or other head preparation). The hex key is then rotated (typically counterclockwise) to rotate the compression screw 220 toward the extended position. As the compression screw 220 continues to be rotated toward the extended position, the head portion 221 of the compression screw 220 will contact and interact with at least a portion of the compression screw aperture 237.

As the compression screw 220 is rotated further toward the extended position, the head portion 221 of the compression screw 220 will be urged against the recessed portion or other portion of the compression screw aperture 237 and urged the attachment element 230 away from the attachment base 210, typically perpendicular to the longitudinal axis, $A_L$, of the attachment base 210.

By urging the attachment element 230 away from the attachment base 210, the compression screw 220 is placed under compression and the recess side walls 236 of the attachment element 230 are urged against the projection side walls 216 of the attachment base 210. By urging the recess sidewalls 236 against the projection sidewalls 216, the attachment element 230 is further secured or attached to the attachment base 210. Because the compression screw 220 is placed under a compressional force (as opposed to the typical tension force that is placed on portions of a typical attachment screw), greater forces can be exerted to urge the recess sidewalls 236 against the projection sidewalls 216, when compared to the amount of force provided by typical intentional attachment, via a typical attachment screw. Thus, the compression screw attachment system 200 provides improved attachment or coupling between the attachment base 210 and the attachment element 230.

Additionally, when the compression screw 220 is rotated to or toward the extended position, the head portion 221 of the compression screw 220 engages the compression screw aperture 237 to further assist in maintaining an appropriately aligned positioned between the attachment base 210 and the attachment element 230 and resist slidable movement of the attachment element 230 relative to the attachment base 210.

If a user desires to remove and/or replace an attachment element 230, the compression screw 220 is rotated from the extended position to the retracted position. Once the compression screw 220 is in the retracted position, the attachment element 230 can be slidably removed from the attachment base 210 and replaced, if desired, by an alternate attachment element 230.

FIGS. 26-28 illustrate an exemplary embodiment of a compression screw attachment system 300. The compression screw attachment system 300 comprises at least some of an attachment base 310 (in the form of a by a "T" shaped accessory rail compatible base) having a top portion 311, a projection 315 having one or more projection side walls 316, one or more compression screw recesses 317, one or more compression screws 320, each having a head portion 321, and an attachment element 330 (in the form of a by a "T" shaped accessory rail compatible attachment element) having an attachment element recess 334 defined by a recess bottom wall 335 and recess sidewalls 336, and a compression screw aperture 337.

It should be appreciated that these elements correspond to and operate similarly to the attachment base 210, having the top portion 211, the projection 215 having the one or more projection side walls 216, the one or more compression screw recesses 217, and the one or more compression screws 220, each having the head portion 221, and the attachment element 230 having an attachment element recess 234 defined by recess sidewalls 236, and a compression screw aperture 237, as described, with reference to compression screw attachment system 200.

However, as illustrated FIGS. 26-28, the picatinny or accessory rail projection 215 of the compression screw attachment system 200 is replaced by a "T" shaped projection 315 having a projection sidewalls 316 and the attachment element recess 234 is replaced by a "T" shaped attachment element recess 334 having a recess bottom wall 335 and recess sidewalls 336. The attachment element 330 may comprise a portion of a scope or optic mount, a sight, a flashlight or illumination device, a laser emitter, a grip portion, a handgrip, a hand stop, a bipod, a camera, a sling mount, a bayonet, or any other device that can be attached or coupled to a picatinny or other accessory rail.

During assembly of the compression screw attachment system 300, as illustrated most clearly in FIGS. 26-28, the compression screw 320 is initially threadedly inserted within the compression screw recesses 317. The compression screw 320 is threadedly inserted within the compression screw recess 317 and rotated (typically clockwise) so as to be in the retracted position (as illustrated, for example, in FIGS. 23 and 24), with the terminal end of the head portion 321 positioned flush or below a terminal surface of the top portion 311 of the attachment base 310. In this manner, the compression screw 320 does not interfere with the ability of the attachment element 330 to be slidably attached to the attachment base 310, via interaction of the projection 315 and the attachment element recess 334.

Once the compression screw 320 is appropriately positioned within the compression screw recess 317, the attachment element 330 is appropriately positioned relative to the attachment base 310, via slidable interaction of the projection 315 and the attachment element recess 334. The attachment element 330 is appropriately positioned such that the hex recess (or other head preparation) of the compression screw 320 is accessible through the compression screw aperture 337.

The hex key (or other appropriate driver or device) is positioned through the compression screw aperture 337, so as to interact with the hex recess (or other head preparation). The hex key is then rotated (typically counterclockwise) to rotate the compression screw 320 toward the extended position. As the compression screw 320 continues to be rotated toward the extended position, the head portion 321 of the compression screw 320 will contact and interact with at least a portion of the compression screw aperture 337.

As the compression screw 320 is rotated further toward the extended position, the head portion 321 of the compression screw 320 will be urged against the recessed portion or other portion of the compression screw aperture 337 and urged the attachment element 330 away from the attachment base 310, typically perpendicular to the longitudinal axis, $A_L$, of the attachment base 310.

By urging the attachment element 330 away from the attachment base 310, the compression screw 320 is placed under compression and the recess side walls 336 of the attachment element 330 are urged against the projection side walls 316 of the attachment base 310. By urging the recess sidewalls 336 against the projection sidewalls 316, the attachment element 330 is further secured or attached to the attachment base 310. Because the compression screw 320 is placed under a compressional force (as opposed to the typical tension force that is placed on portions of a typical attachment screw), greater forces can be exerted to urge the recess sidewalls 336 against the projection sidewalls 316, when compared to the amount of force provided by typical intentional attachment, via a typical attachment screw. Thus, the compression screw attachment system 300 provides improved attachment or coupling between the attachment base 310 and the attachment element 330.

Additionally, when the compression screw 320 is rotated to or toward the extended position, the head portion 321 of the compression screw 320 engages the compression screw aperture 337 to further assist in maintaining an appropriately aligned positioned between the attachment base 310 and the attachment element 330 and resist slidable movement of the attachment element 330 relative to the attachment base 310.

If a user desires to remove and/or replace an attachment element 330, the compression screw 320 is rotated from the extended position to the retracted position. Once the compression screw 320 is in the retracted position, the attachment element 330 can be slidably removed from the attachment base 310 and replaced, if desired, by an alternate attachment element 330.

Thus, it should be appreciated that the cross-sectional or other shape of the projection 115, 215, or 315 is not restricted to the cross-sectional or other shapes specifically described and/or illustrated herein, but can be any desired cross-sectional or other shape. Similarly, the cross-sectional or other shape of the attachment element recess 134, 234, or 334 is not restricted to the cross-sectional or other shapes specifically described and/or illustrated herein, but can be any cross-sectional or other shape that can be attached or coupled to the projection.

While the present disclosure has been described in conjunction with the exemplary embodiments outlined above, the foregoing description of exemplary embodiments of the present disclosure, as set forth above, are intended to be illustrative, not limiting and the fundamental disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A compression screw attachment system, comprising:

an attachment base, wherein at least one recess portion is formed in a portion of said attachment base, between opposing ends of said attachment base, wherein a discrete alignment pin extends from said attachment base within said at least one lock portion, wherein a projection extends from at least one of said opposing ends of said attachment base, wherein said projection is defined by two projection sidewalls, wherein a compression screw recess extends from a terminal surface of said projection;

at least one compression screw extending to a head portion of said compression screw, wherein said compression screw can be repeatably threadably rotated within said compression screw recess between a retracted position in which said compression screw is positioned within said compression screw recess such that a terminal end of said compression screw does not extend beyond said terminal surface of said projection and an extended position in which said terminal end of said compression screw extends beyond said terminal surface of said projection; and one or more attachment elements, each of said attachment elements having a head portion and an extension portion, each of said attachment elements having at least one recess bottom wall and at least two recess sidewalls at least partially defining an attachment element recess formed within a portion of each of said one or more attachment elements, wherein a compression screw aperture is formed through said recess bottom wall, wherein if said compression screw is in said retracted position, said attachment element recess is mateable with said projection of said attachment base and wherein if said compression screw recess is aligned with said compression screw aperture, said compression screw is threadedly rotatable to said extended position, wherein at least a portion of said head portion of said compression screw contacts a surface of said recess bottom wall and provides a force to at least a portion of said at least one recess bottom wall to urge each respective one of said at least two recess sidewalls against a corresponding respective one of said two projection sidewalls.

2. The compression screw attachment system of claim 1, wherein said projection is a substantially dovetail shaped projection and wherein said attachment element recess is a substantially dovetail shaped attachment element recess.

3. The compression screw attachment system of claim 1, wherein said alignment pin has a substantially circular cross section.

4. The compression screw attachment system of claim 1, wherein said alignment pin is inserted within a recess formed in said attachment base.

5. The compression screw attachment system of claim 1, wherein a projection extends from each of said opposing ends of said attachment base.

6. The compression screw attachment system of claim 1, wherein said compression screw recess is centered relative to said terminal surface of said at least one projection.

7. The compression screw attachment system of claim 1, wherein said compression screw aperture is centered relative to said attachment element recess.

8. The compression screw attachment system of claim 1, wherein said attachment element recess extends through opposing sides of said head portion of a respective one of said attachment elements.

9. The compression screw attachment system of claim 1, wherein said one or more attachment elements are each interchangeable relative to said at least one projection of said attachment base.

10. The compression screw attachment system of claim 1, wherein said compression screw aperture includes a tapered portion extending from said attachment element recess, such that at least a head portion of said compression screw is able to be centered relative to said compression screw aperture if said head portion of said compression screw interacts with said tapered portion of said compression screw aperture.

11. The compression screw attachment system of claim 1, wherein an appropriate driver or device is at least partially positionable through said compression screw aperture to interact with said compression screw.

12. A compression screw attachment system, comprising:

an attachment base having at least one recess portion formed in a portion of said attachment base, between opposing ends of said attachment base, wherein a discrete alignment pin extends from said attachment base within said at least one lock portion, said attachment base having at least one substantially dovetail shaped projection extending from said attachment base, wherein said at least one substantially dovetail shaped projection is defined by two projection sidewalls, wherein an at least partially internally threaded compression screw recess extends from a terminal surface of said at least one substantially dovetail shaped projection;

at least one at least partially externally threaded compression screw, wherein said compression screw can be repeatably threadably rotated within said compression screw recess between a retracted position in which a terminal end of said compression screw does not extend beyond said terminal surface of said at least one substantially dovetail shaped projection and an extended position in which said terminal end of said compression screw extends beyond said terminal surface of said at least one substantially dovetail shaped projection; and one or more attachment elements, each of said attachment elements having a head portion and an extension portion, each of said attachment elements having a substantially dovetail shaped attachment element recess formed within a portion of each of said one or more attachment elements, wherein at least one recess bottom wall and at least two recess sidewalls at least partially define said substantially dovetail shaped attachment element recess, wherein a compression screw aperture is formed through said recess bottom wall, wherein if said compression screw is in said retracted position, said substantially dovetail shaped attachment element recess is slidably mateable with said at least one substantially dovetail shaped projection of said attachment base and wherein if said compression screw recess is aligned with said compression screw aperture, said compression screw is threadedly rotatable to said extended position, wherein at least a portion of a head portion of said compression screw contacts a surface of said recess bottom wall and provides a force to at least a portion of said at least one recess bottom wall to urge each respective one of said at least two recess sidewalls against a corresponding respective one of said two projection sidewalls.

13. The compression screw attachment system of claim 12, wherein said alignment pin has a substantially circular cross section.

14. The compression screw attachment system of claim 12, wherein said alignment pin is inserted within a recess formed in said attachment base.

15. The compression screw attachment system of claim 12, wherein a substantially dovetail shaped projection extends from each of said opposing ends of said attachment base.

16. The compression screw attachment system of claim 12, wherein said at least partially internally threaded compression screw recess is centered relative to said terminal surface of said at least one projection.

17. The compression screw attachment system of claim 12, wherein said compression screw aperture is centered relative to said substantially dovetail shaped attachment element recess.

18. A compression screw attachment system, comprising:

an attachment base having at least one recess portion is formed in a portion of said attachment base, between opposing ends of said attachment base, wherein a discrete alignment pin extends from said attachment base within said at least one lock portion, said attachment base having a substantially dovetail shaped projection defined by two projection sidewalls, wherein an at least partially internally threaded compression screw recess extends from a terminal surface of said substantially dovetail shaped projection;

at least one at least partially externally threaded compression screw repeatably threadably rotatable within said compression screw recess between a retracted position in which a terminal end of said compression screw does not extend beyond said terminal surface of said substantially dovetail shaped projection and an extended position in which said terminal end of said compression screw extends beyond said terminal surface of said substantially dovetail shaped projection; and two or more attachment elements, each of said attachment elements having a head portion and an extension portion, each having a substantially dovetail shaped attachment element recess at least partially defined by at least one recess bottom wall and at least two recess sidewalls, wherein each said substantially dovetail shaped attachment element recess extends through opposing sides of said head portion of a respective one of said attachment elements, wherein a compression screw aperture is formed through said recess bottom wall, wherein if said compression screw is in said retracted position, said substantially dovetail shaped attachment element recess is slidably mateable with said substantially dovetail shaped projection of said attachment base and wherein if said compression screw recess is aligned with said compression screw aperture, said compression screw is threadedly rotatable to said extended position, wherein at least a portion of a head portion of said compression screw contacts a surface of said recess bottom wall and provides a force to at least a portion of said at least one recess bottom wall to urge each respective one of said at least two recess sidewalls against a corresponding respective one of said two projection sidewalls.

19. The compression screw attachment system of claim 18, wherein said compression screw recess is an at least partially internally threaded compression screw recess.

20. The compression screw attachment system of claim 18, wherein a substantially dovetail shaped projection extends from each of said opposing ends of said attachment base.

* * * * *